US008800189B2

(12) United States Patent
Fitzpatrick et al.

(10) Patent No.: US 8,800,189 B2
(45) Date of Patent: Aug. 12, 2014

(54) BUFFER TUBE FOR MODULAR GUNSTOCK

(75) Inventors: Richard M. Fitzpatrick, Longmont, CO (US); Stephen C. Hines, Edgewood, NM (US)

(73) Assignee: Magpul Industries Corp, Erie, CO (US)

( * ) Notice: Subject to any disclaimer, the term of this patent is extended or adjusted under 35 U.S.C. 154(b) by 396 days.

(21) Appl. No.: 10/905,312

(22) Filed: Dec. 27, 2004

(65) Prior Publication Data

US 2011/0258899 A1 Oct. 27, 2011

Related U.S. Application Data

(63) Continuation-in-part of application No. 10/180,429, filed on Jun. 25, 2002, now Pat. No. 6,651,371.

(51) Int. Cl.
*F41C 23/00* (2006.01)

(52) U.S. Cl.
USPC ..... 42/71.01; 42/73

(58) Field of Classification Search
USPC ..... 42/71.01, 72, 73, 74, 75.03
See application file for complete search history.

(56) References Cited

U.S. PATENT DOCUMENTS

| | | | | | |
|---|---|---|---|---|---|
| 2,100,514 | A | * | 11/1937 | Miller et al. | 42/71.01 |
| 4,327,626 | A | * | 5/1982 | McQueen | 89/197 |
| 5,173,564 | A | * | 12/1992 | Hammond, Jr. | 42/75.03 |
| 5,909,002 | A | | 6/1999 | Atchisson | 89/130 |

* cited by examiner

*Primary Examiner* — Daniel J Troy
(74) *Attorney, Agent, or Firm* — Geoffrey E. Dobbin; Dobbin IP Law P.C.

(57) ABSTRACT

The present invention is a buffer tube assembly 2 upon which stock modules may be mounted as part of a modular stock system. The best mode buffer tube features a uniform cheek plate 10 with a track 9 disposed underneath the cheek plate 10 on either side. Rail track 8 is disposed on the underside of buffer tube module 2 and is divided in half by a longitudinal groove. Interface detents 5 are provided on the sides of buffer tube module 2. Both rail track 8 and detents 5 are provided for interface with adjustable length stock modules. Individual half-rails of the rail track 8 may be angled to improve interface performance with adjustable for length stock modules. A clip hole 13 is provided as a securement means with fixed length stock modules. The invention may also be practiced as a mounting assembly for those firearms (usually air projection type) that do not require a buffer area.

14 Claims, 5 Drawing Sheets

BUFFER TUBE FOR MODULAR GUNSTOCK

CROSS-REFERENCES TO RELATED APPLICATIONS AND PATENTS

This Application is a Continuation-in-Part application of U.S. application Ser. No. 10/180,429, filed on 25 Jun. 2002 and includes the specification and disclosure of the aforementioned application by reference. This Application is also a national phase entry under 35 USC 371 of application PCT/US2003/019952, published and communicated to the USPTO on Dec. 31, 2003 as WO 2004/001322.

TECHNICAL FIELD

The invention relates to the field of buffer tubes for firearms, and more specifically is a buffer tube adapted for a modular gunstock to be used on traditional powder and non-powder based firearms.

BACKGROUND ART

The concept of a buffer tube is known in the field of gunsmithing, particularly for bolt-action firearms. The buffer tube is a hollow area that may be immediately and distally disposed from the firing chamber and allows for the reduction of the reactive force, known commonly as "kick," caused by the recoil of the firing bolt assembly. Buffer tubes for automatic rifles are usually concealed within the weapon's stock. For example, U.S. Pat. No. 5,909,002 (1999) is illustrative of the prior art, depicting such a buffer tube assembly. Other buffer tube assemblies, particularly those for shotguns, are mounted beneath the barrel.

While the aforementioned inventions accomplish their individual objectives, they do not describe a buffer tube that serves both as a buffer assembly and a mounting arm for a modular stock assembly. In this respect, the buffer tube according to the present invention departs substantially from the usual designs in the prior art. In doing so, this invention provides not only the recoil reduction found in standard designs of buffer tubes in the art, but also a specific mounting apparatus for interchangeable stocks for a firearm. The assembly also may be adapted to fit non-powder (i.e. air) based weapons.

DISCLOSURE OF THE INVENTION

In view of the foregoing disadvantages inherent in the known types of buffer tubes, this invention provides an improved buffer tube as a part of a modular stock system. As such, the present invention's general purpose is to provide a new and improved buffer tube that will provide an anchor for a modular stock system. Similarly, the present invention also provides a uniform mounting platform for a modular stock system for non-bolt-type guns, such as air rifles or shotguns.

To attain these goals, the invention is a generally oblong body designed to interface with a weapon's receiver. The interface used by the mount will be dependent on the receiver. In most cases, the interface will be a threaded interface. For firing-bolt-type firearms and others requiring a buffer region, the mount includes a hollow buffer region, for the installation of whatever prior art recoil reduction the weapon requires. Where the mount differs from the prior art is primarily the use of a uniform cheek plate, on the upper surface of the mount. In order to attain this feature, the mount includes two longitudinal tracks, located in a distal relation to the cheek plate. Stock modules designed for this system attach to the mount by these tracks and do not cover the cheek plate. A more advanced embodiment includes an adjustment track located on the underside of the mount. The adjustment track allows for the use of adjustable-for-length stock modules and can, in a still further advanced embodiment, provide a securement safety feature.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BEST MODE FOR CARRYING OUT THE INVENTION

Figure 1:
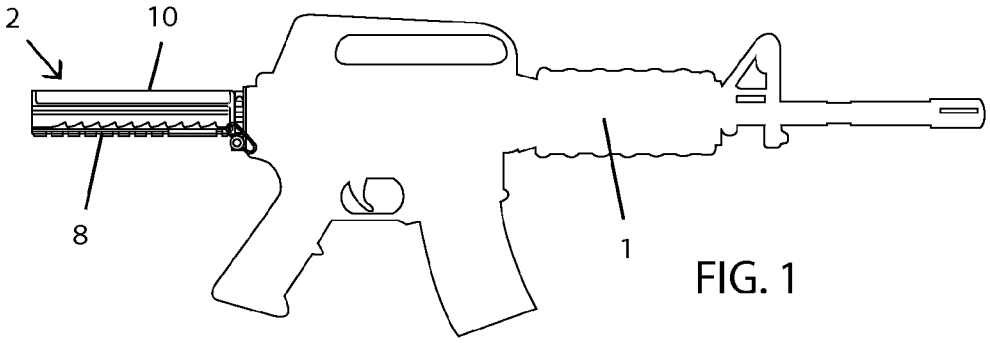
FIG. 1 is a right elevation of a representational rifle having a buffer tube according to the present invention installed.
Figure 1A:
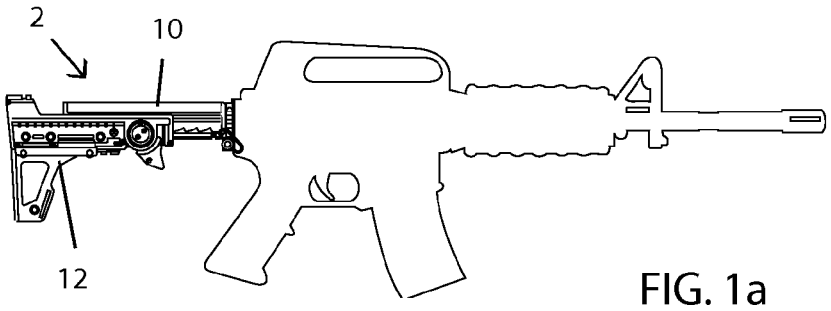
FIG. 1*a* is the rifle of FIG. 1 with an adjustable stock attachment.
Figure 1B:
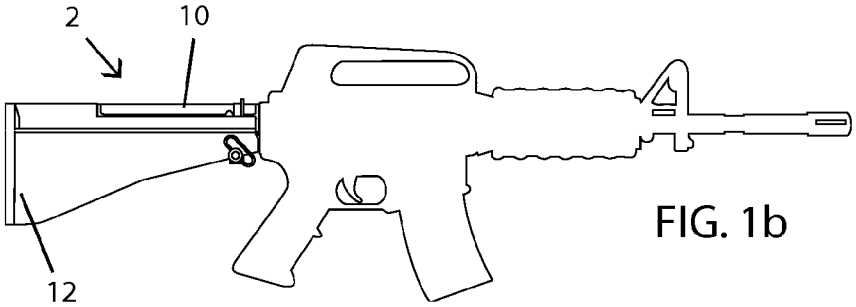
FIG. 1*b* is the rifle of FIG. 1 with a fixed stock attachment.
Figure 1C:
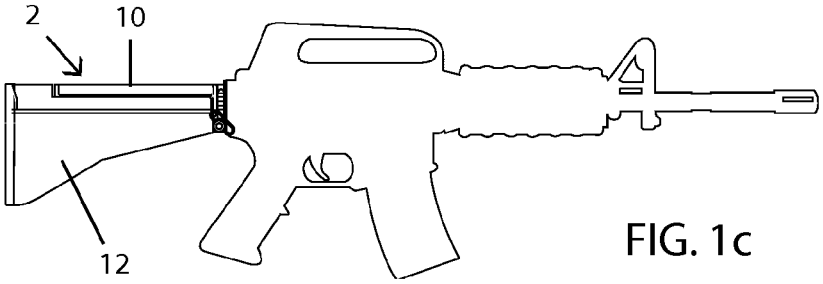
FIG. 1*c* is the rifle of FIG. 1 with a "shorty" fixed stock attachment

With reference now to the drawings, the preferred embodiment of the buffer tube is herein described. With reference to FIG. 1, the buffer tube module 2 is attached to rifle 1 at the receiver by the buffer tube 4 (FIG. 2) at an interface 17. Buffer tube module 2 has two distinct surfaces. The first is top surface is covered with cheek plate 10. Two longitudinal grooves 9, shown in FIG. 4, are disposed slightly underneath cheek plate 10 providing attachment grooves for stock module 12. The second is the bottom surface, FIG. 2, which is covered with rail track 8. Rail track 8 is also used for interfacing with stock modules 12, such as the one shown in FIG. 1*a*, namely an adjustable for length stock. Clip hole 13 is provided for a clip attachment with a fixed length stock, such as those shown in FIGS. 1*b* and 1*c*. In addition, referencing FIGS. 2, 3 and 4, rail track 8, with individual lateral grooves 6 and single transverse groove 7, is disposed towards the ground and cheek plate 10 is disposed upwards and is generally parallel to buffer tube 4. Ideally, the cheek plate 10 is fused onto the buffer tube 4. However, in alternative embodiments, enough space can be left between buffer tube 4 and cheek plate 10 to allow for unhindered motion of a cylindrical stock module. Tooth interfaces 5 are disposed underneath the longitudinal grooves 9.

Figure 2:
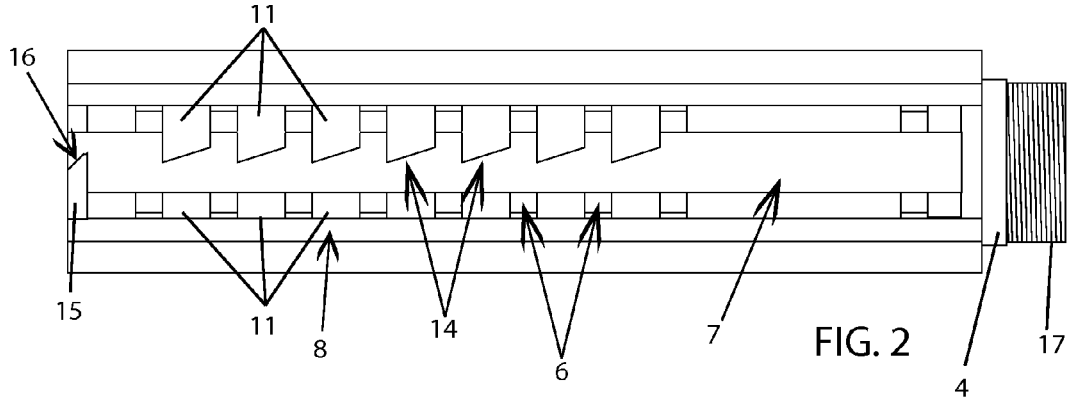
FIG. 2 is a bottom plan view of the modified buffer tube module.
Figure 3:
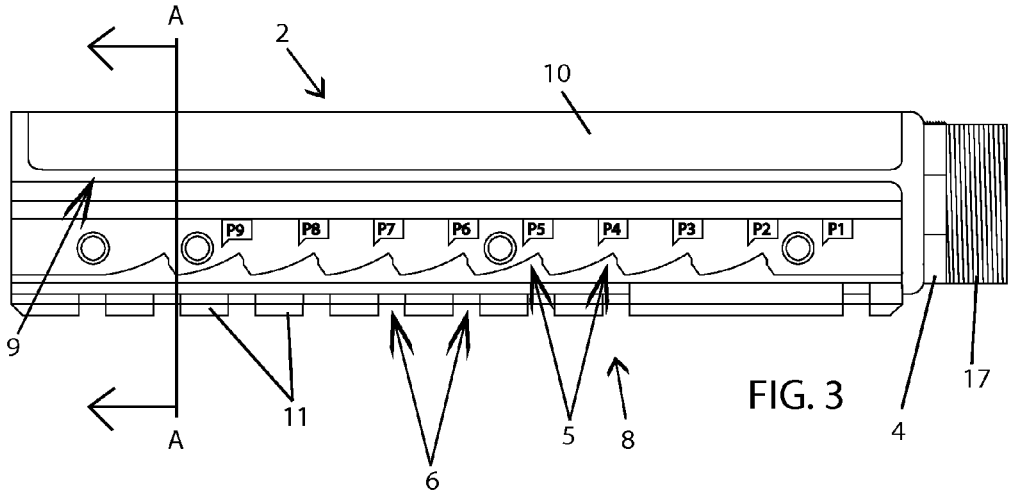
FIG. 3 is a side elevation of the modified buffer tube module.
Figure 4:
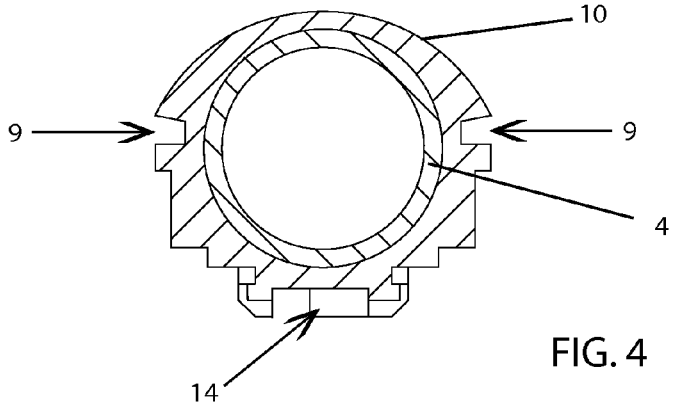
FIG. 4 is a cross section of the buffer tube module of FIG. 3 taken at line 4.

A more detailed look at the buffer tube, particularly FIGS. 2 and 3, reveals that rail track 8 is bisected by channel 7, leaving half-rails 11. This is to allow for a ratcheting securement system with the stock modules as described in the parent applications. These applications, incorporated herein by reference, include an interface tooth that moves laterally with respect to the buffer tube and stock modules. The innermost edge 14 of each pair of the half-rails may be angled. The angled rail edges 14 allow for motion backwards, without difficulty. The majority of these innermost edges 14 face the buffer tube interface 17. The final rail 15 is angled in the opposite direction 16, preventing the stock module from being pulled off the tube module and allowing easier initial mounting of the stock module to the buffer tube module.

Figure 5A:
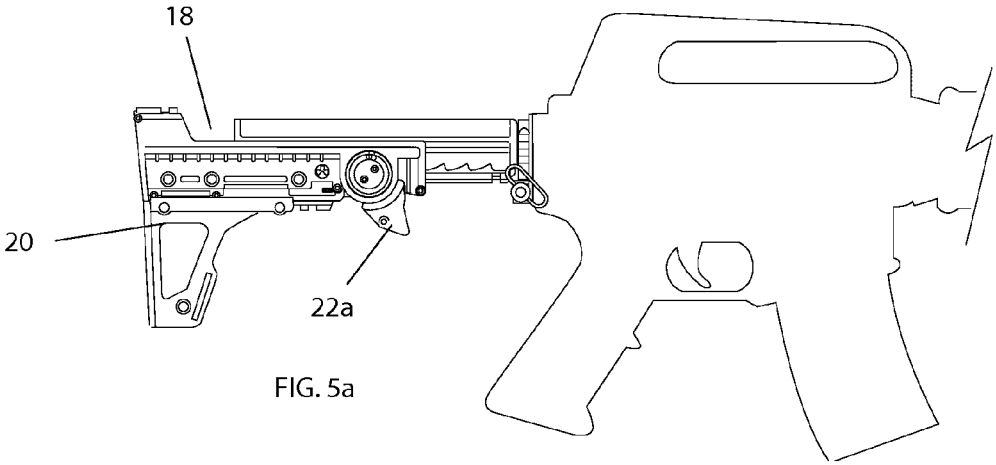
FIG. 5 is a three staged side elevation showing the use of the adjustable stock embodiment.
Figure 5B:
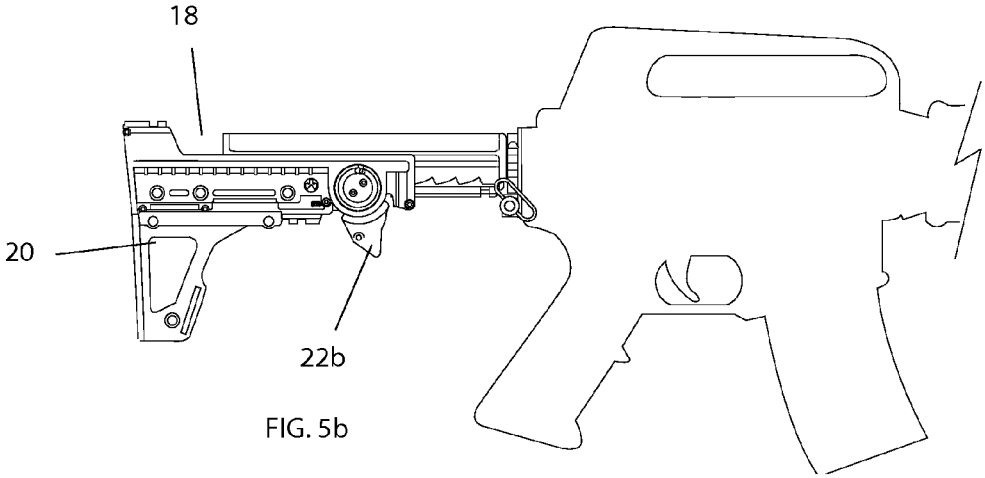
Figure 5C:
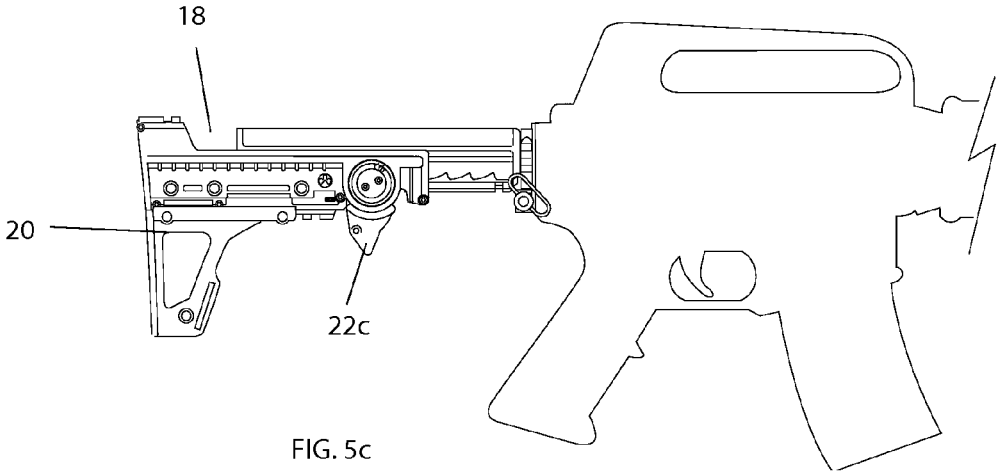

In use, the buffer tube module provides a mount for stock module 12, shown in FIGS. 1 and 5. Stock modules will have a receiving cradle 18 and an actual stock portion 20. Cradle 18 allows cheek plate 10 to remain exposed and constant regardless of the stock module used. It also remains constant with an adjustable stock, as shown in FIG. 5. Stock module 12 may be positioned at any length and cheek plate 10 remains constant. FIG. 5 also depicts the latching mechanism 22*a*, 22*b*, 22*c* at three different stages of contact with the rail track 8, allowing for no motion, unilateral motion and free motion respectively.

Figure 6A:
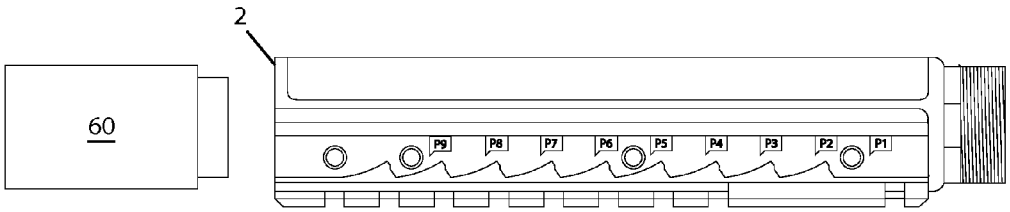
FIGS. 6*a* and 6*b* are side elevational views of the modified buffer tube module from FIG. 3, detailing an adjustable tube length embodiment.
Figure 6B:
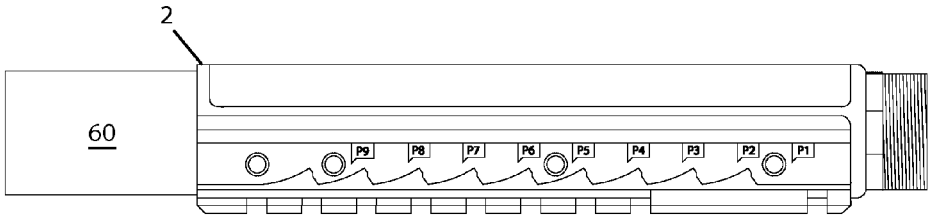
Figure 6C:
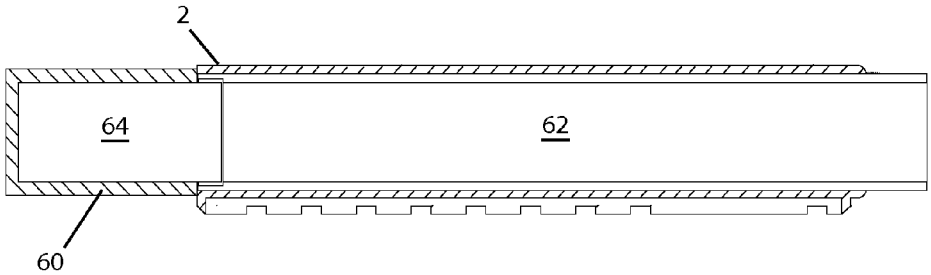
FIG. 6*c* is a cross-sectional view of the buffer tube module of FIG. 6*b*.

FIGS. 6*a* and 6*b* depicts a buffer tube module with an adjustable length buffer tube. End cap 60 is threadingly engaged to the inside of the buffer tube 4, shown in FIG. 6*c*. The end cap 60 may then be screwed into or out of the buffer tube 4 to the weapon's specifications. End cap 60 may be configured in any manner that threadingly engages the buffer tube 4, including configurations that entirely fit inside the buffer tube (for shortening the length of the buffer region 62) or the extension embodiment, with hollow extension area 74, shown in FIGS. 6*a*-6*c*

Figure 7:
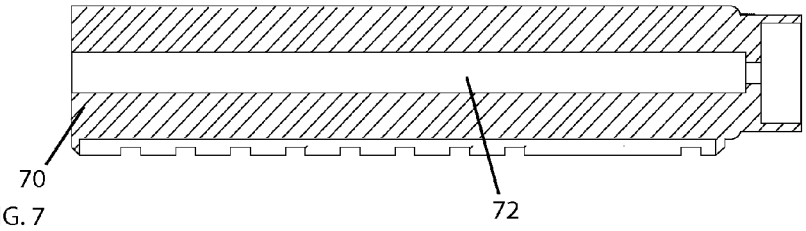
FIG. 7 is a cross-sectional view of the modified buffer tube from FIG. 3, as a simple mount with no buffer region.

FIG. 7 shows the buffer tube module as a mounting module for weapons not requiring a buffer area. As can be seen in the cross section, what would normally be hollow is instead a solid or semi-solid mounting module 70. A small area 72 may be included for compressed air or ease of manufacture.

Figure 8:
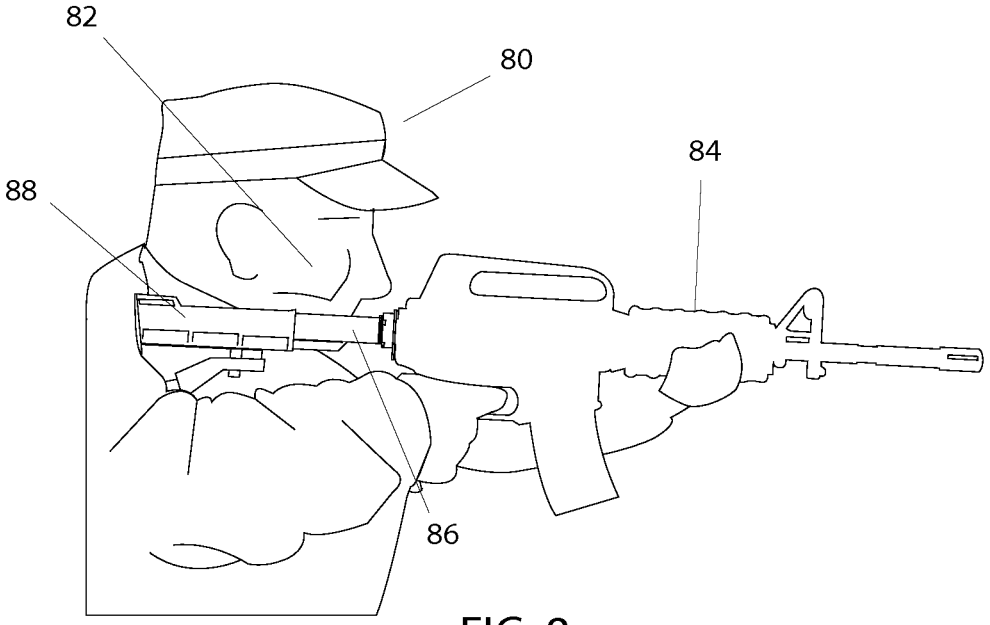
FIG. 8 is a depiction of a user with a prior art collapsible stock.
Figure 9:
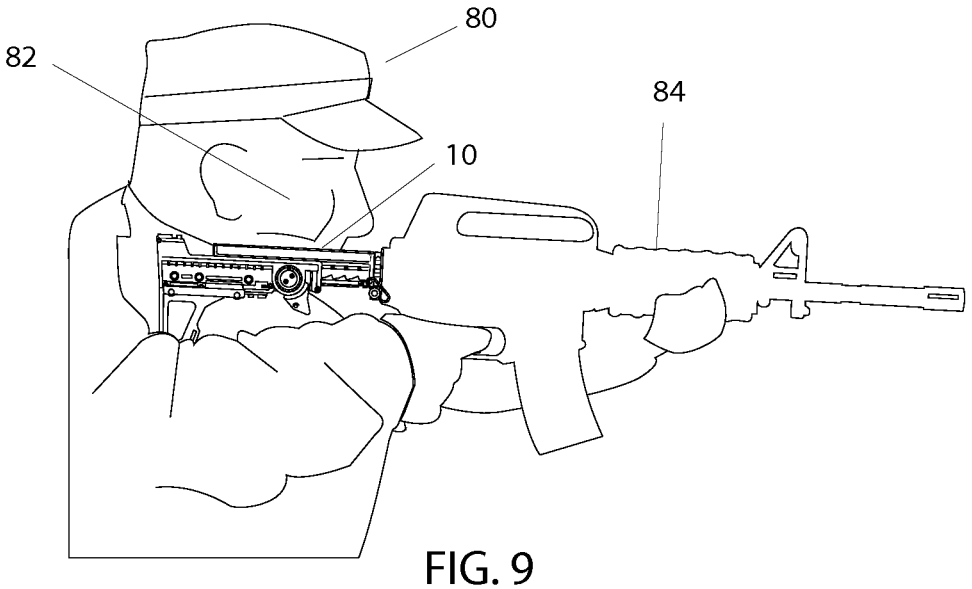
FIG. 9 is a depiction of a user with an adjustable for length stock using the buffer tube module of the present invention

FIG. 8 shows the prior art adjustable stock configuration. Notice that user 80 places cheek 82 against the weapon 84. Cheek 82 is positioned against the juncture of the fore 86 and hind 88 portions of the stock. This not only causes discomfort but also interferes with the use of the weapon. FIG. 9 shows use of the buffer tube of the present invention with an associated stock module. User's cheek 82 is now placed against cheek plate 10, eliminating discomfort and minimizing disruption caused by placement at the juncture as in the prior art.

Although the present invention has been described with reference to preferred embodiments, numerous modifications and variations can be made and still the result will come within the scope of the invention. No limitation with respect to the specific embodiments disclosed herein is intended or should be inferred.

INDUSTRIAL APPLICATION

The invention is readily practiced in the field of weapons technology, as it can replace the buffer tube of any firearm requiring a buffer region and may be used with no internal buffer tube for those firearms that do not so require buffering. Once installed, the invention provides a mounting structure for a new stock system. In manufacture, the invention is readily molded from any polymer, fiberglass, metal, plastic or any other suitable material. In the case of a module with a buffer tube, a simple metal tube is easily incorporated as a base in the molding process.

What is claimed is:

1. In combination with a stock module, a modified buffer tube assembly for a modular gunstock for a firearm comprising:

a. an assembly body, having an outer surface about a cylindrical tube, and an interior of the cylindrical tube defining a hollow buffer region, the outer surface further comprising a rail track, defined by uniform lateral grooves and likewise uniform rails located distally on the buffer tube assembly;

b. an interface adapted to attach the assembly body to a firearm receiver, the buffer region having an opening through the interface;

c. a uniform cheek plate, disposed towards an uppermost portion of the outer surface of the assembly body; and d. two longitudinal grooves, each disposed beneath and on either side of the uniform cheek plate in the outer surface of the assembly body, the longitudinal grooves providing a mounting interface for the stock module such that the uniform cheek plate of the assembly body remains entirely exposed after the stock module is slid along the longitudinal grooves of the buffer tube assembly wherein the rail track is configured to secure the stock module in a plurality of positions.

2. The buffer tube assembly of claim 1, further comprising an end cap, manufactured to threadingly engage the cylindrical tube at an end opposite the end interfacing with the receiver, thereby allowing an internal length of the buffer region to be adjusted.

3. The buffer tube assembly of claim 1, the outer surface further comprising a plurality of tooth interfaces located beneath the longitudinal grooves.

4. In combination with a stock module, a mounting assembly for a modular gunstock for a firearm comprising:

a. an elongate mounting assembly base;

b. an interface on one end of the mounting assembly base for attachment to a firearm receiver;

c. a uniform cheek plate, disposed towards an uppermost portion of the mounting-assembly base;

d. two longitudinal grooves, each disposed beneath and on either side of the uniform cheek disposed on an outer surface of the mounting assembly base and the stock module is mounted upon the mounting assembly by way of the two longitudinal grooves in a manner that the uniform cheek plate remains entirely exposed when the stock module slides along the longitudinal grooves.

5. The buffer tube assembly of claim 4, further comprising an end cap, manufactured to threadingly engage the mounting assembly base at an end opposite the end interfacing with the receiver, thereby allowing a length of the mounting assembly to be adjusted.

6. The buffer tube assembly of claim 5, the outer surface further comprising a plurality of tooth interfaces located beneath the longitudinal grooves.

7. The buffer tube assembly of claim 5, the outer surface further comprising a rail track, defined by uniform lateral grooves and likewise uniform rails located distally on the buffer tube assembly, wherein the rail track is configured to secure the stock module in a plurality of positions.

8. The buffer tube assembly of claim 4, the outer surface further comprising a plurality of tooth interfaces located beneath the longitudinal grooves.

9. The buffer tube assembly of claim 4, the outer surface further comprising a rail track, defined by uniform lateral grooves and likewise uniform rails located distally on the buffer tube assembly, wherein the rail track is configured to secure the stock module in a plurality of positions.

10. In combination with a stock module, a modified buffer tube assembly for a modular gunstock for a firearm comprising:

a. an assembly body, having an outer surface about a cylindrical tube, and an interior of the cylindrical tube defining a hollow buffer region;

b. an interface adapted to attach the assembly body to a firearm receiver, the buffer region having an opening through the interface;

c. a uniform cheek plate, disposed towards an uppermost portion of the outer surface of the assembly body;

d. two longitudinal grooves, each disposed beneath and on either side of the cheek plate in the outer surface of the assembly body, the longitudinal grooves providing a mounting interface for the stock module such that the uniform cheek plate of the assembly body remains entirely exposed after the stock module is slid along the longitudinal grooves of the buffer tube assembly.

11. The buffer tube assembly of claim 10, further comprising an end cap, manufactured to threadingly engage the cylindrical tube at an end opposite the end interfacing with the receiver, thereby allowing an internal length of the buffer region to be adjusted.

12. The buffer tube assembly of claim 11, the outer surface further comprising a plurality of tooth interfaces located beneath the longitudinal grooves.

13. The buffer tube assembly of claim 11, the outer surface further comprising a rail track, defined by uniform lateral grooves and likewise uniform rails located distally on the buffer tube assembly, wherein the rail track is configured to secure the stock module in a plurality of positions.

14. The buffer tube assembly of claim 10, the outer surface further comprising a plurality of tooth interfaces located beneath the longitudinal grooves.

* * * * *